United States Patent [19]

Hay et al.

[11] 4,365,800

[45] Dec. 28, 1982

[54] MARTIAL ARTS STRIKER DEVICE

[76] Inventors: Hugh W. Hay; John L. Hay, both of 1 Pennant Mews, London W.8, England

[21] Appl. No.: 85,539

[22] Filed: Oct. 17, 1979

[30] Foreign Application Priority Data

Oct. 24, 1978 [GB] United Kingdom ..... 41654/78

[51] Int. Cl.[3] ..... A63J 5/00

[52] U.S. Cl. ..... 272/76; 272/8 N

[58] Field of Search ..... 272/76, 78; 273/55 R

[56] References Cited

U.S. PATENT DOCUMENTS 2,767,985 10/1956 Maxcey, Jr. et al. ..... 273/55 R
3,610,615 10/1971 Cleary ..... 272/76
4,004,799 1/1977 Kundert ..... 272/76

OTHER PUBLICATIONS

"Black Belt", pg. 18, Jan. 1976.

*Primary Examiner*—Richard C. Pinkham
*Assistant Examiner*—T. Brown
*Attorney, Agent, or Firm*—Fleit & Jacobson

[57] ABSTRACT

A device comprising mounting means, a striker member which is adapted to be struck by a limb of a person, and locking means for locking the striker member in position until such time as the striker member is struck with a force which is sufficiently large to operate the locking means whereupon the striker member will move under the force of the blow from the person's limb.

2 Claims, 7 Drawing Figures

MARTIAL ARTS STRIKER DEVICE

This invention relates to a martial arts striker device.

In martial arts such for example as karate, the limbs of a person such for example as their hands, elbows and feet are employed to strike various devices. It is an aim of the present invention to provide a device which is of assistance to persons engaged in martial arts who wish to practice their various blows.

Accordingly, this invention provides a device comprising mounting means, a striker member which is adapted to be struck by a limb of a person, and locking means for locking the striker member in position until such time as the striker member is struck with a force which is sufficiently large to operate the locking means whereupon the striker member will move under the force of the blow from the person's limb.

In one embodiment of the invention, the mounting means and the striker member are such that when the striker member is struck with a force which is sufficiently large to operate the locking means, then the striker member moves as a whole bodily towards the mounting means.

In this embodiment of the invention, the device may be one in which the mounting means comprises a support plate and an extension member which extends away from the support plate, and in which the striker member has an extension member which extends away from the striker member, the two extension members being such that they slide one within the other, the locking means being mounted on the extension members. The locking means may be a ball acting in a groove, the ball being forced out of the groove when the striker member is struck with a force which is sufficiently large to operate the locking means whereupon one extension member will slide into the other extension member. Preferably, the extension member of the striker member slides within the extension member of the mounting means, the extension member of the striker member being provided with the groove.

In a second embodiment of the invention, the device may be one in which the mounting means and the striker member are such that when the striker member is struck with a force which is sufficiently large to operate the locking means, then the striker member breaks into two parts which pivot about the mounting means.

In this second embodiment of the invention, the device may be one in which the mounting means comprises a frame which is C-shaped in side view, and in which the striker member is in two parts which are adapted to separate and pivot about the ends of the frame when the striker member is struck with a force which is sufficiently large to operate the locking means, the locking means being mounted partly on one part of the striker member and partly on the other part of the striker member. The locking means may be a ball which operates in a spiral groove in a rod.

The striker member may be made of various materials such for example as metals, rubber and wood. Examples of metals are steel and alluminium. In some instances, a striker member made entirely of a metal may be too hard so that the striker member may then advantageously be covered with a rubber material or with wood.

Embodiments of the invention will now be described solely by way of example and with reference to the accompanying drawings in which.

Figure 1:
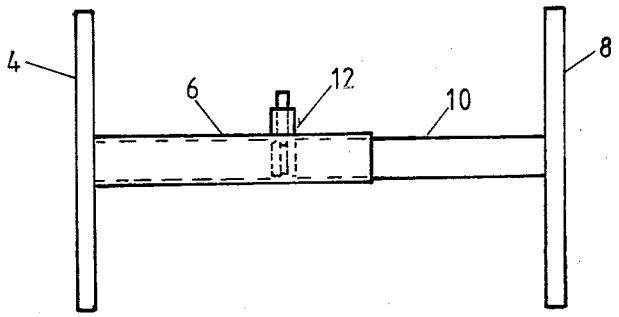
FIG. 1 is a side view of a first device in accordance with the invention.
Figure 3:
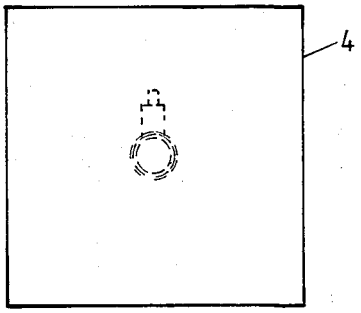
FIG. 3 is an end view of the device shown in FIG. 1.
Figure 2:
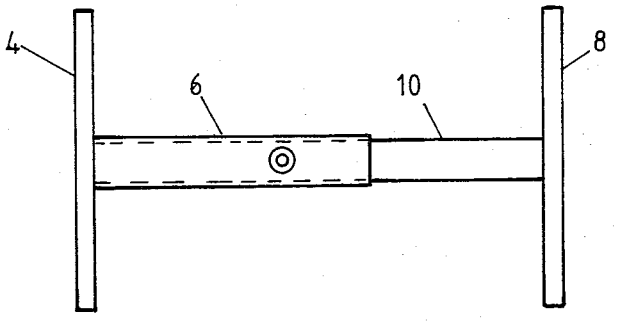
FIG. 2 is a plan view of the device shown in FIG. 1.
Figure 4:
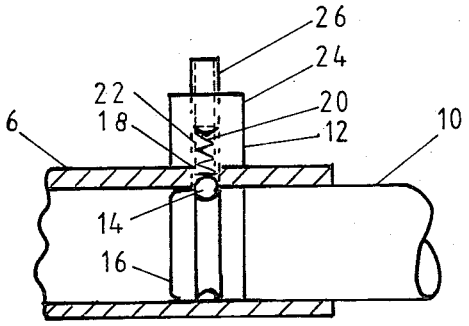
FIG. 4 is a detail of the part encircled by the line A.

Referring to FIGS. 1 to 4, there is shown a device 2 comprising mounting means in the form of a mounting plate 4 which has a hollow tubular extension member 6 extending away from it. The device 2 further comprises a striker member 8 which has an extension member 10 extending away from it and into the extension member 6.

The device 2 further comprises locking means 12 for locking the striker member 8 in position until such time as the striker member 8 is struck with a force which is sufficiently large to operate the locking means 12 whereupon the striker member 8 moves as a whole bodily towards the plate 4. The locking means 12 comprises a ball 14 acting in a groove 16 formed in the extension member 10. The ball 14 passes through an aperture 18 in the extension member 6 and it is biased into the groove 16 by means of a spring 20. The spring 20 is housed in a bore 22 provided in a casing 24, the casing 24 being provided with an adjustor screw device 26 for varying the force with which the spring 20 acts on the ball 14.

Figure 5:
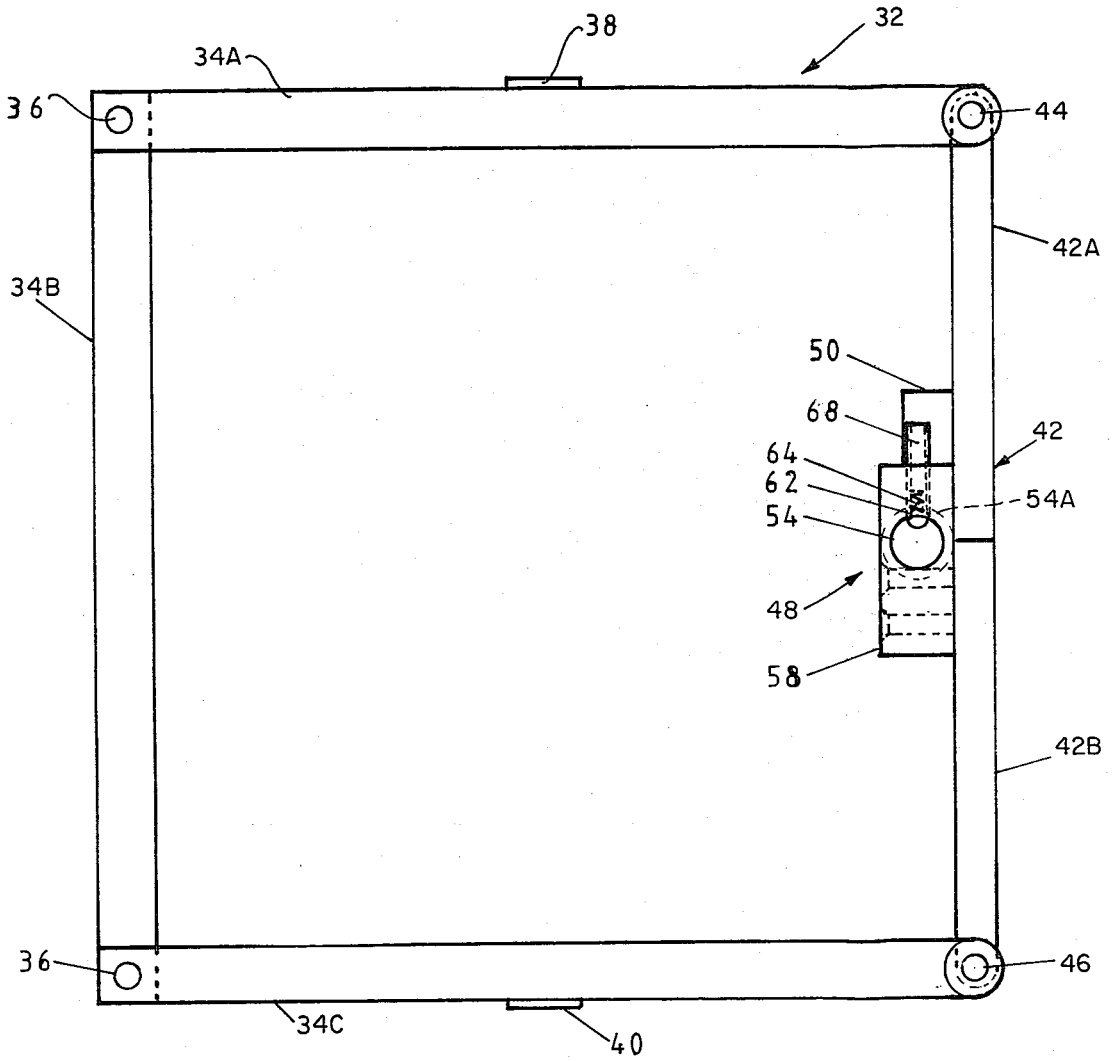
FIG. 5 is a side view of a second device in accordance with the invention.
Figure 6:
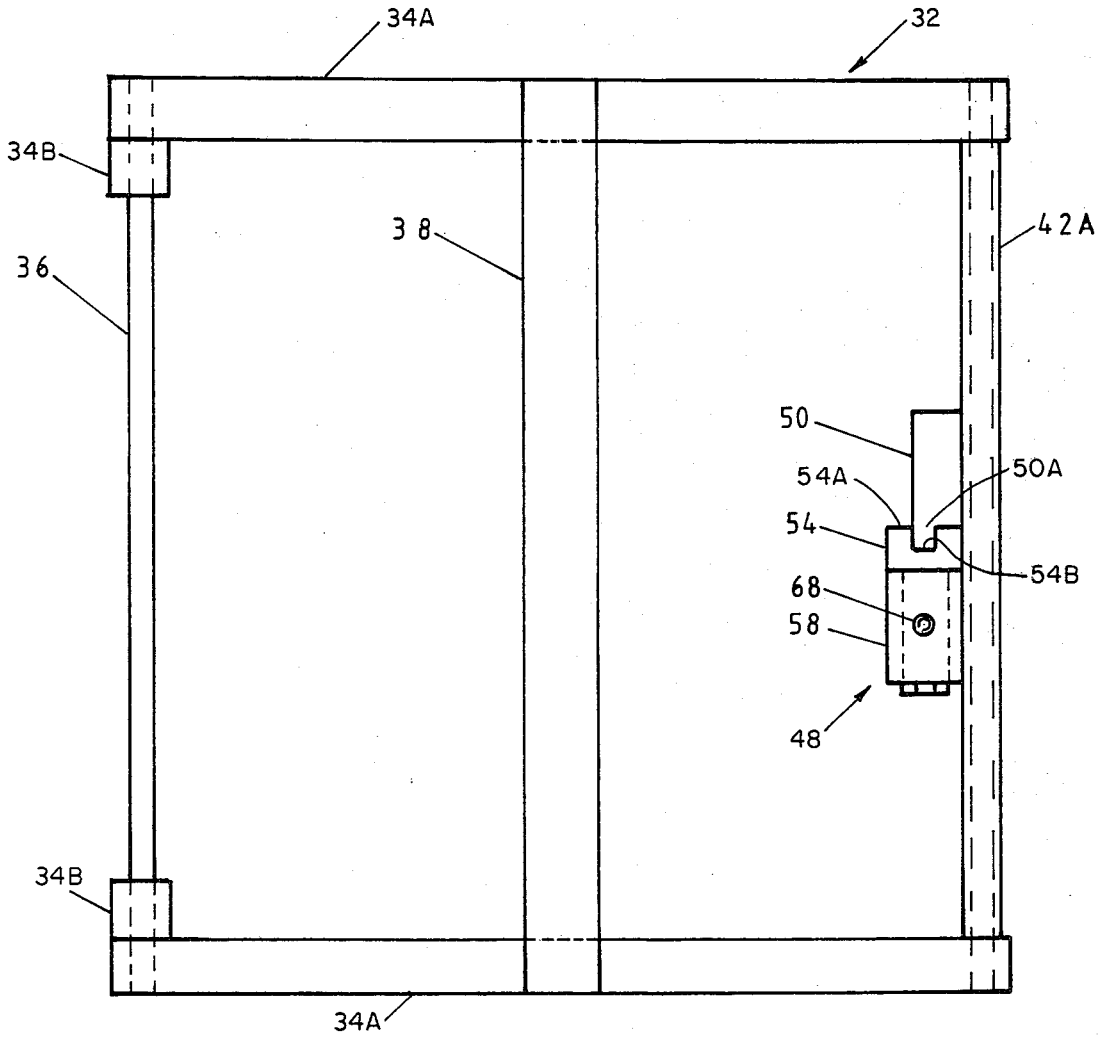
FIG. 6 is a top plan view of the device shown in FIG. 5.
Figure 7:
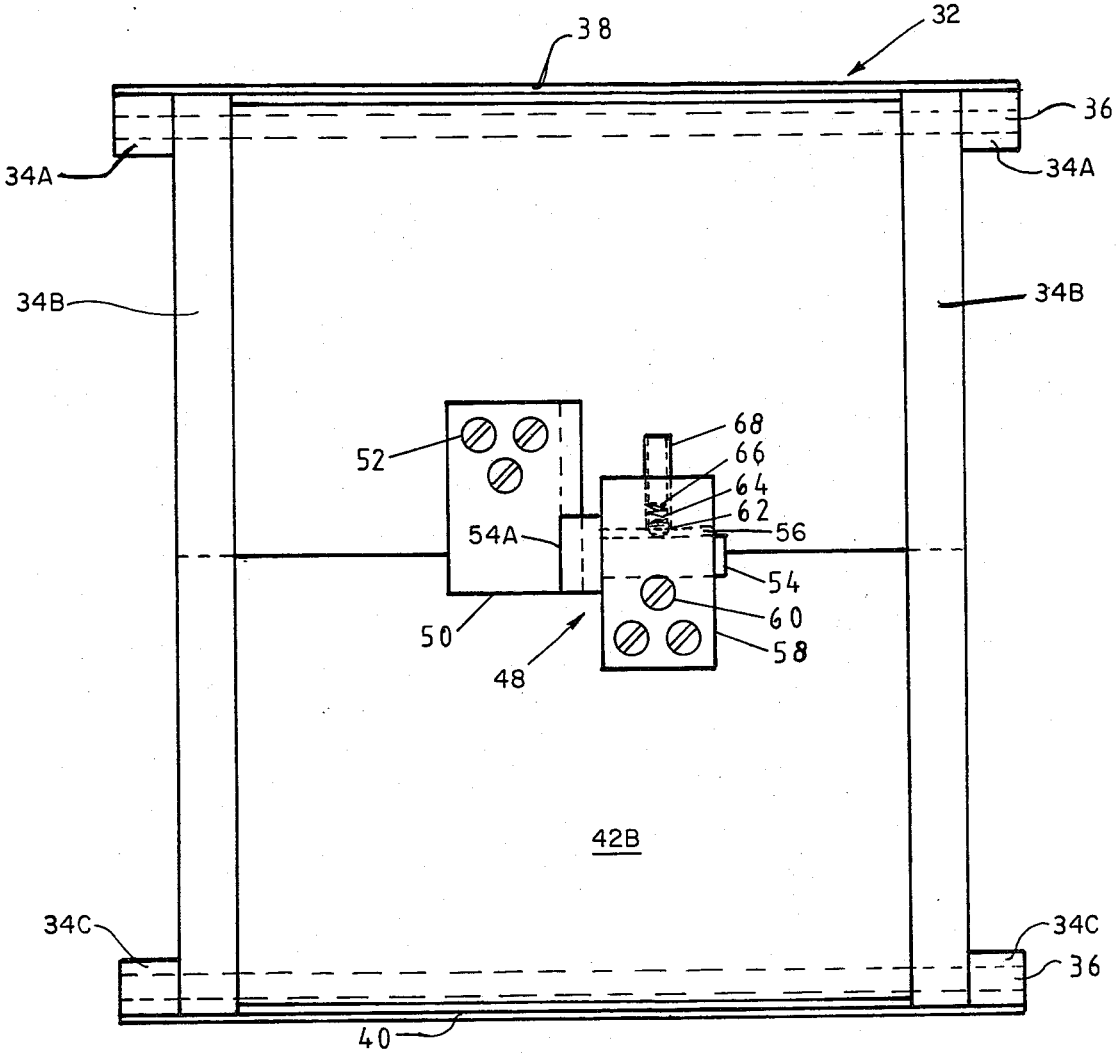
FIG. 7 is a rear end view of the device shown in FIG. 5.

In use of the device 2, the ball 14 remains in the groove 16 until such time as the striker member 8 is hit sufficiently hard to force the ball 14 back up the bore 22 against the pressure of the spring 20 and out of the groove 16. When this happens, the extension member 10 will slide into the extension member 6 and the striker member 8 will move towards the plate 4. The device 2 can be reset by pulling the extension member 10 back out of the extension member 6 until the ball 14 relocates in the groove 16. If it is desired to make the removal of the ball 14 from the groove 16 easier or harder, then an appropriate adjustment can be made on the device 26. Referring now to FIGS. 5 to 7, there is shown a device 32 comprising a square support frame defined by parallel pairs of frame members 34A, 34B, 34C, and 36. The frame also comprises a brace 38 which extends between the frame members 34A and a brace 40 which extends between the frame members 34C. The device 32 further comprises a striker member 42 which is in two parts 42A and 42B. The part 42A of the striker board pivots about pivot points 44 at one side of the frame and the part 42B of the striker board pivots about pivot points 46 at the other side of the frame 34. This pivoting occurs when the striker member 42 is struck with a force which is sufficiently large to operate locking means 48 which then allows the striker member 42 to break in half and pivot about the pivot points 44, 46.

The locking means 48 comprises a first portion 50 which is secured to the part 42A of the striker member 42 by three screws 52. The locking means 48 also comprises a second part 58 which is secured to the part 42B of the striker member 42 by three screws 60. The part 58 supports a rod 54 which is provided with a spiral groove 56. A ball 62 is spring biased by a spring 64 into the groove 56. The spring 64 operates in a bore 66 and the force with which the spring 64 acts on the ball 62 can be adjusted by a threaded adjustment device 68. The rod 54 is thus attached to the part 42A and the ball 64 is attached to the part 42B. Whilst the ball 64 is in the groove 56 of the rod 54, the ball 64 is effective to hold the two parts 42A and 42B together. The rod 54 is rotatable in the part 58. The rod 54 has a head 54A, and the head 54A is provided with a slot 54B. The slot 54B receives a lip 50A of the first part 50.

Whilst the ball 62 is in the groove 56 of the rod 54, the ball 62 is effective to hold the two parts 42A and 42B together because the rod 54 cannot turn, and the lip 50A stays in the slot 54B. In use of the device 32, when the striker member 42 is hit sufficiently hard, the two parts 42A, 42B try to separate and because the lip 50A is in the slot 54B, the lip 50A causes the head 54A to turn. The entire head 54 then turns and the ball 62 is caused to travel along the groove 56 and if it travels sufficiently far it runs out of the groove 56. The head 54A will then have rotated sufficiently far that the lip 50A can slide out of the slot 54B and the two parts 42A and 42B of the striker member 42 can then split apart and pivot downwardly about their respective pivot points 44, 46. Obviously, by reversing the direction of pivotal motion, the two parts 42A and 42B of the striker member 42 can be brought back together again and the locking device 48 can then be operated with the ball 64 returning to the groove 56. If it is desired to make it easier or harder to operate the locking device 48, then an appropriate adjustment can be made on the threaded adjustment device 68 to make it easier or harder for the ball 64 to travel along the groove 56.

It is to be appreciated that the embodiments of the invention described above have been given by way of example only and that modifications may be effected. Thus, for example, other constructions for the mounting and the locking means may be employed. Also, the shape of the striker member may be varied and it may be made from a single material or a laminate.

What we claim is:

1. A device comprising a frame, a striker member having first and second parts which are each pivotally mounted to the frame, and locking means for locking the first and the second parts of the striker member together until the striker member is struck by a limb of a person with a force which is sufficiently large to operate the locking means whereupon the first and the second parts of the striker member will separate and pivot about the frame, the locking means having a first lock portion which is secured to the first part of the striker member and a second lock portion which is secured to the second part of the striker member, the first lock portion having a lip protruding therefrom and the second lock portion comprising a part secured to the second part of the striker member, and having a bore formed therein, a rod member having a head with a slot formed therein for receiving the lip, a rod protruding from the head and having a groove formed therein, said rod being rotatable is said bore, and a ball member which is biased into position in the groove, whereby the ball member acts in the groove to maintain the first and second parts of the striker member together until such time as the striker member is struck with the said sufficiently large force whereupon the ball member is caused to move out of the groove to allow said rod to rotate in said bore thereby allowing the first and the second parts of the striker member to separate and pivot about the frame.

2. A device according to claim 1 in which the groove is a spiral groove, and in which the ball member is biased into position in the spiral groove by a coil spring.

* * * * *